US005141413A

United States Patent [19]

Bennitt

[11] Patent Number: 5,141,413

[45] Date of Patent: Aug. 25, 1992

[54] GAS COMPRESSOR HAVING A VARIABLE-VOLUME CLEARANCE POCKET, AND MEANS FOR VARYING A CLEARANCE POCKET IN A GAS COMPRESSOR

[75] Inventor: Robert A. Bennitt, Painted Post, N.Y.

[73] Assignee: Dresser-Rand Company, Corning, N.Y.

[21] Appl. No.: 765,730

[22] Filed: Sep. 26, 1991

[51] Int. Cl.[5] ..... F04B 21/04

[52] U.S. Cl. ..... 417/523; 417/275; 417/534

[58] Field of Search ..... 417/274, 275, 276, 455, 417/523, 534, 570

[56] References Cited

U.S. PATENT DOCUMENTS 3,938,425 2/1976 Kroffke ..... 417/274

4,486,148 12/1984 Battah ..... 417/275

*Primary Examiner*—Richard A. Bertsch

*Assistant Examiner*—Charles G. Freay

*Attorney, Agent, or Firm*—Bernard J. Murphy

[57] ABSTRACT

The compressor has a straight cylinder wholly confined within which are inlet valves, and reciprocatable discharge valves. One inlet valve is set in place by a centerbolt which can be turned by a wrench (or the like) to move the inlet valve to selected positions relative to its confronting discharge valve, whereby the volume of the clearance pocket is varied. The centerbolt mounted inlet valve, then, comprises an instrument for selectively varying the clearance pocket volume, obviating any need for any special clearance pocket varying devices or components.

12 Claims, 2 Drawing Sheets

Figure 1:
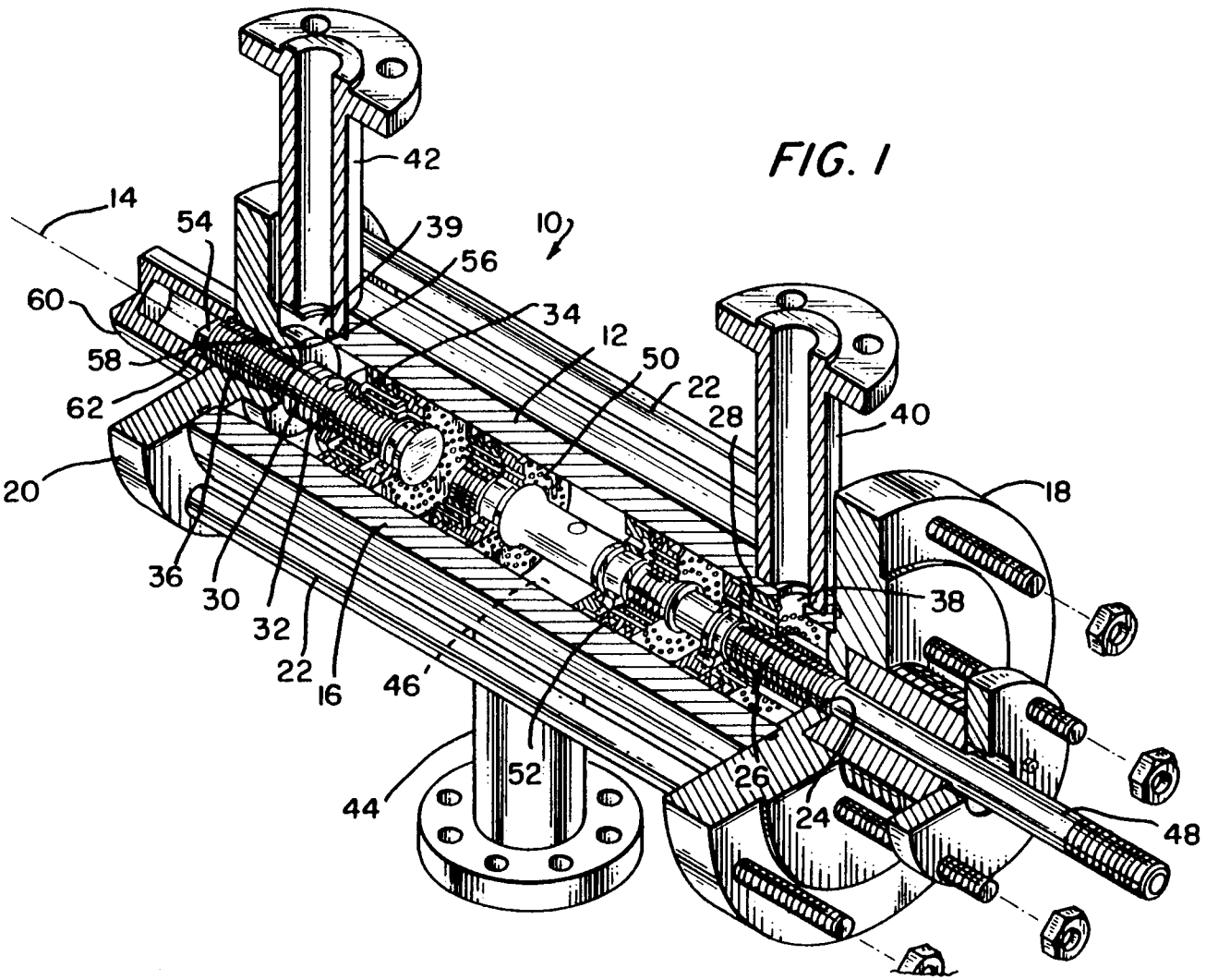

GAS COMPRESSOR HAVING A VARIABLE-VOLUME CLEARANCE POCKET, AND MEANS FOR VARYING A CLEARANCE POCKET IN A GAS COMPRESSOR

This invention pertains to gas compressors, especially those of the reciprocating piston type, and in particular to a gas compressor of the aforesaid type which has a variable-volume clearance pocket, and to means for varying a clearance pocket in such a gas compressor.

The clearance volume or clearance pocket of gas compressors is normally varied, to alter the capacity of the compressor, by extraneous devices and/or components attached to the cylinder head, such devices or components being designed to satisfy that very function: vary the volume or pocket obtaining between the piston and the cylinder head.

It is an object of this invention to obviate the need for extraneous or special devices and components for varying the volume of the clearance pocket, by setting forth a gas compressor devoid of such, but which can effect the adjustment in any event, and by disclosing, as well, means for varying a clearance pocket in a gas compressor, without resort to the aforesaid special devices and components.

Particularly it is an object of this invention to set forth a gas compressor, having a variable-volume clearance pocket, comprising a single, straight cylinder having (a) a longitudinal axis, and (b) a circumferential wall; and headers secured to opposite, axial ends of said cylinder; wherein each of said headers has a hole formed centrally therein which opens into said cylinder; at least one of said headers has said centrally-formed hole threadedly tapped; and further including a first inlet valve threadedly engaged with said tapped hole in said one header; a second inlet valve removably secured in said centrally-formed hole in another of said headers; wherein said second inlet valve has a throughgoing bore formed centrally therein; a piston rod in slidable penetration of said bore in said second inlet valve, and having a first end thereof projecting outwardly from, and a second end thereof extending inwardly from, said another header; a pair of discharge valves coupled to said second end of said piston rod, and spaced apart along said second end, confined within said cylinder; gas inlet ports, radially formed in said wall adjacent opposite axial ends of said cylinder, and opening in proximity to said inlet valves; and a gas outlet port formed in said wall, intermediate said axial ends of said cylinder; wherein said first inlet valve, one said discharge valve, and said wall define a clearance pocket at one of said axial ends of said cylinder; and said first inlet valve comprises means for selectively varying the volume of said pocket.

It is also an object of this invention to disclose, in a gas compressor having a straight cylinder, inlet and discharge valves confined within said cylinder, means for admitting gas into and discharging gas therefrom, and means for reciprocating said discharge valves to compress gas therewithin, means for selectively varying a clearance pocket obtaining between an inlet valve and a discharge valve, comprising a centerbolt securing an inlet valve within said cylinder, in a given spaced relationship of said inlet valve to a discharge valve; wherein said centerbolt has a terminal end which projects outwardly from said cylinder; and said terminal end has a tool-engageable configuration manipulatable for varying said spaced relationship.

Figure 2:
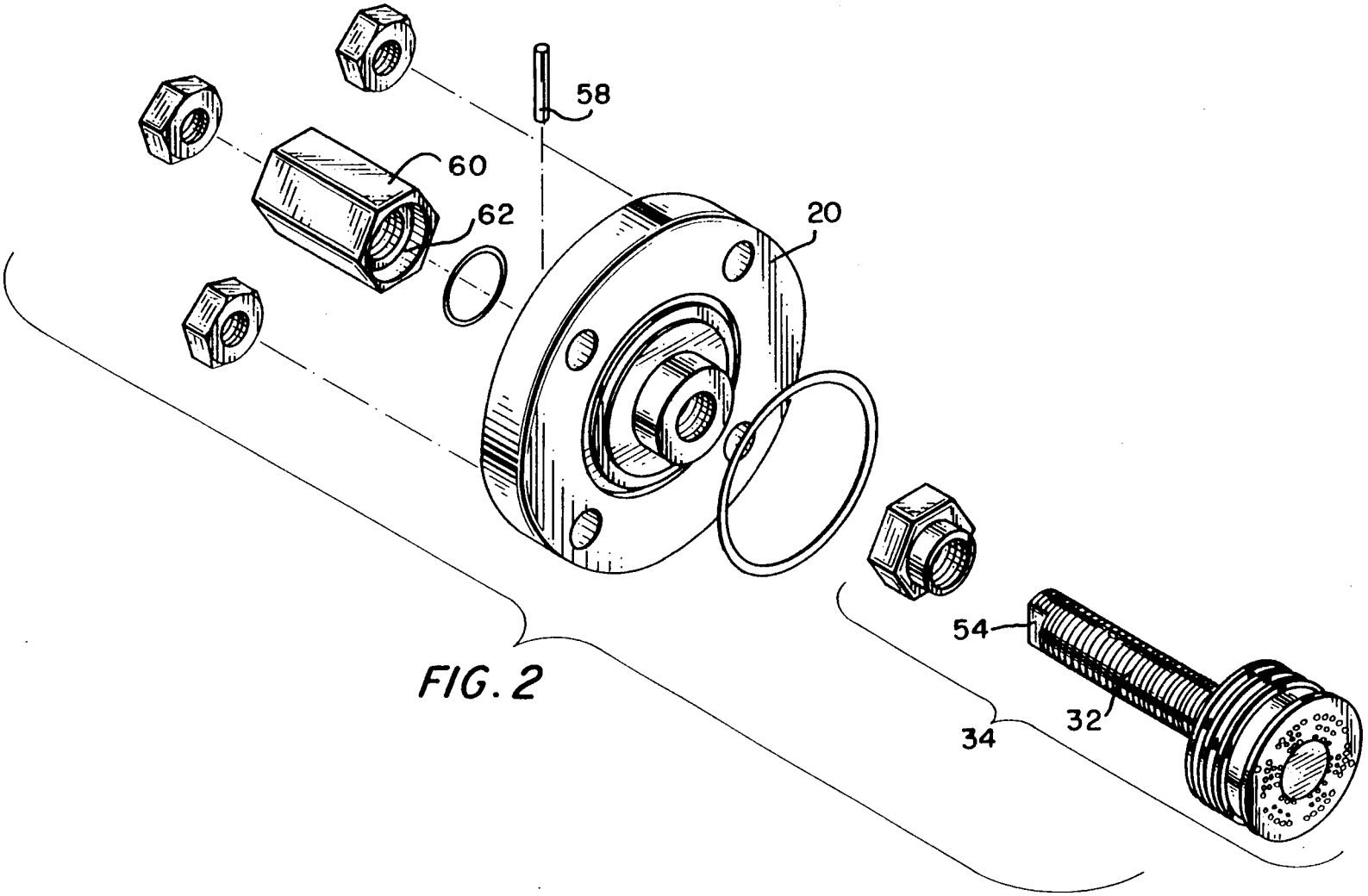

Further objects of this invention, as well as the novel features thereof, will become apparent by reference to the following description, taken in conjunction with the accompanying figures, in which:

FIG. 1 is a perspective illustration of a gas compressor having a variable-volume clearance pocket, according to an embodiment of the invention; and FIG. 2 is an exploded view, in perspective, of the outer head assembly of the compressor of FIG. 1, the same comprising the novel means for selectively varying a clearance pocket.

The instant invention comprises an improvement of the inventions set forth in U.S. Pat. No. 5,011,383, issued on Apr. 30th, 1991, for A Valve Assembly, for use in Combination with a Straight-Cylinder, Gas-Compression Chamber, and in Combination Therewith, and U.S. Pat. No. 5,015,158, issued on May 14th, 1991, for a Gas Compressor, both said patents having issued to this applicant. For an understanding of the nature of the valves, and the general assembly of the instant gas compressor, reference is directed to the cited patents; for such background, both patents are incorporated herein by reference.

As shown in the figures, the compressor 10, according to an embodiment of the invention, comprises a single, straight cylinder 12 having a longitudinal axis 14 and a circumferential wall 16. Inner and outer headers 18 and 20, respectively, are secured to opposite axial ends of the cylinder 12 by four tie bolts 22 (only two of which are visible). The inner header 18 has a threaded bore 24 formed centrally therein to receive a hollow, inlet valve mounting bolt 26. Bolt 26, of course, secures an inlet valve 28 in place within the cylinder 12. The outer header 20 also has a tapped bore 30 formed centrally therein to receive a centerbolt 32 which, similarly, secures a second inlet valve 34 in place within the cylinder 12. Outer header also has a larger, unthreaded bore 36, coaxial with bore 30, formed therein for a purpose which is explained in subsequent text.

The inlet valves 28 and 34 are so positioned in the cylinder that they are adjacent to, and open to, inlet ports 38 and 39. Outwardly flanged conduits 40 and 42 are fixed in communication with the ports 38 and 39. Another, outwardly flanged conduit 44 is fixed to a discharge or outlet port 46 (not visible) which is formed in the wall 16 intermediate the axial ends of the cylinder 12. A piston rod 48 is slidably received in inlet valve 28 mounting bolt 26. It has a first end which projects outwardly from header 18 for coupling thereof to a prime mover (not shown), and a second end which extends inwardly from the header. The second, inner end of the rod 48 mounts a pair of discharge valves 50 and 52 thereon, and spaced apart along the rod end.

All the valves: inlet valves 28 and 34, and discharge valves 50 and 52, are the same as, or virtually the same as, the valve described in the aforecited U.S. Pat. No. 5,011,383 and, accordingly, it is deemed unnecessary to detail the structure thereof here. Too, the valves are fixed to their headers 18 and 20, and to the piston rod 48, as detailed in the indicated U.S. Pat. No. 5,018,158, and function as described in said patents, with one significant difference.

In the aforenoted patents, that which corresponds to the outer header 20 had no throughgoing bore. As priorly noted, outer header 20 has the tapped bore 30, in which to receive the centerbolt 32, as a means of fixing the inlet valve 34 in a given relationship to discharge valve 50. Too, header 20 also has the larger, untapped bore 36 in which to accommodate an outwardly projecting portion of the centerbolt 32. The outward, terminal end of the centerbolt 32 has flats 54 (only one is visible) formed thereon to receive a wrench, or like tool, threadedly to turn the centerbolt 32 inwardly or outwardly, relative to the cylinder 12. By thus turning the centerbolt 32, the clearance volume or pocket which obtains between valve 34 and valve 50 is enlarged or diminished, to vary the capacity of the compressor 12. Consequently, it is the inlet valve 34 itself, via its mounting center-bolt 32, which offers a selective, variable-volume clearance pocket.

Bore 36 in header 20 defines an abutment 56 where it joins the bore 30. The same provides a limit stop for the inward travel of the centerbolt 32, in that the latter carries a dowel 58 radially therein, with a projecting portion. The projecting portion of the dowel 58 is unobstructed, as it traverses the bore 36, but prevents further, inward travel of the centerbolt 32 as the projecting portion impinges against the abutment 56, and valve 34, carried by centerbolt 32 is fixed in an innermost setting.

An acorn nut 60 is threadedly coupled to the end of the centerbolt 32, and made fast against the header 20. It shield the end of the centerbolt so that, once a setting of the variable volume of the clearance pocket is made, it will not, inadvertently, be disturbed. Too, the acorn nut 60 has an abutment 62 therewithin, for defining an outermost limit of travel of the centerbolt 32. If the acorn nut 60 will thread onto the centerbolt 32, but can not be made fast up against the header 20, it will clearly indicate that the centerbolt is outwardly turned too far.

While I have described my invention in connection with a specific embodiment thereof, it is to be clearly understood that this is done only by way of example, and not as a limitation to the scope of the invention, as set forth in the objects thereof and in the appended claims.

I claim:

1. A gas compressor, having a variable-volume clearance pocket, comprising:

a single, straight cylinder having (a) a longitudinal axis, and (b) a circumferential wall; and headers secured to opposite, axial ends of said cylinder; wherein each of said headers has a hole formed centrally therein which opens into said cylinder;

at least one of said headers has said centrally-formed hole threadedly tapped; and further including a first inlet valve threadedly engaged with said tapped hole in said one header;

a second inlet valve removably secured in said centrally-formed hole in another of said headers;

said second inlet valve has a throughgoing bore formed centrally therein;

a piston rod in slidable penetration of said bore in said second inlet valve, and having a first end thereof projecting outwardly from, and a second end thereof extending inwardly from, said another header;

a pair of discharge valves coupled to said second end of said piston rod, and spaced apart along said second end, confined within said cylinder;

gas inlet ports, radially formed in said wall adjacent opposite axial ends of said cylinder, and opening in proximity to said inlet valves; and a gas outlet port formed in said wall, intermediate said axial ends of said cylinder; wherein said first inlet valve, one said discharge valve, and said wall define a clearance pocket at one of said axial ends of said cylinder; and said first inlet valve comprises means for selectively varying the volume of said pocket.

2. A gas compressor, according to claim 1, wherein:

said first inlet valve has a centerbolt;

an end of said centerbolt is threadedly in penetration of said tapped hole in said one header; and said end of said centerbolt has a tool-engageable configuration.

3. A gas compressor, according to claim 2, wherein:

said one header and said centerbolt have means cooperative for delimiting a threadedly inward penetration or travel of said centerbolt relative to said one header.

4. A gas compressor, according to claim 2, wherein:

said one header has an annular abutment; and said centerbolt has means, extending therefrom engageable with said abutment for delimiting a threadedly inward penetration or travel of said center-bolt relative to said one header.

5. A gas compressor, according to claim 2, further including:

an acorn nut threadedly engaged with said end of said centerbolt and made fast against said one header.

6. A gas compressor, according to claim 5, wherein:

said nut has an annular abutment; and said centerbolt has means, extending therefrom, engageable with said abutment for defining a limit of a threadedly outward travel of said centerbolt relative to said one header.

7. A gas compressor, according to claim 4, wherein:

said abutment engageable means comprises a dowel, set in said centerbolt and having an end thereof projecting radially from said centerbolt.

8. A gas compressor, according to claim 7, wherein:

said one header further has an untapped bore, coaxial with said tapped bore, and said end of said dowel travels through said untapped bore, upon said centerbolt being threadedly turned inwardly and outwardly relative to said one header.

9. In a gas compressor having a straight cylinder, inlet and discharge valves confined within said cylinder, means for admitting gas into and discharging gas therefrom, and means for reciprocating said discharge valves to compress gas therewithin, means for selectively varying a clearance pocket obtaining between an inlet valve and a discharge valve, comprising:

a centerbolt securing an inlet valve within said cylinder, in a given spaced relationship of said inlet valve to a discharge valve; wherein said centerbolt has a terminal end which projects outwardly from said cylinder; and said terminal end has a tool-engageable configuration manipulatable for varying said spaced relationship.

10. Means for varying a clearance pocket, according to claim 9, wherein:

said cylinder of said gas compressor has a header at one cylinder end;

said header has a threaded bore formed therein, centrally thereof; and said centerbolt is threadedly engaged with said bore.

11. Means for varying a clearance pocket, according to claim 10, wherein:

said header and said centerbolt have means cooperative for delimiting a threaded travel, of said centerbolt, inwardly relative to said header.

12. Means for varying a clearance pocket, according to claim 11, wherein:

said travel delimiting means comprises an annular abutment formed in said header, and a dowel, set in said centerbolt which has an end thereof projecting radially from said centerbolt, for impingement of said dowel end with said abutment.

* * * * *